US010669600B2

(12) United States Patent
Tada et al.

(10) Patent No.: US 10,669,600 B2
(45) Date of Patent: Jun. 2, 2020

(54) METHOD OF MANUFACTURING GRAIN-ORIENTED ELECTRICAL STEEL SHEET

(71) Applicant: NIPPON STEEL & SUMITOMO METAL CORPORATION, Tokyo (JP)

(72) Inventors: Hirotoshi Tada, Himeji (JP); Nobusato Morishige, Kobe (JP); Naoto Masumitsu, Narashino (JP); Junichi Takaobushi, Himeji (JP); Shin Furutaku, Himeji (JP); Masaru Takahashi, Nishinomiya (JP)

(73) Assignee: NIPPON STEEL CORPORATION, Tokyo (JP)

( * ) Notice: Subject to any disclaimer, the term of this patent is extended or adjusted under 35 U.S.C. 154(b) by 153 days.

(21) Appl. No.: 15/562,387

(22) PCT Filed: Apr. 1, 2016

(86) PCT No.: PCT/JP2016/060921
§ 371 (c)(1),
(2) Date: Sep. 27, 2017

(87) PCT Pub. No.: WO2016/159349
PCT Pub. Date: Oct. 6, 2016

(65) Prior Publication Data

US 2018/0282830 A1 Oct. 4, 2018

(30) Foreign Application Priority Data

Apr. 2, 2015 (JP) ..... 2015-075839

(51) Int. Cl.
*C21D 6/00* (2006.01)
*C21D 9/46* (2006.01)
(Continued)

(52) U.S. Cl.
CPC ..... *C21D 6/008* (2013.01); *C21D 8/12* (2013.01); *C21D 8/1222* (2013.01);
(Continued)

(58) Field of Classification Search
None
See application file for complete search history.

(56) References Cited

U.S. PATENT DOCUMENTS

2004/0231752 A1 11/2004 Nanba et al.
2011/0155285 A1 6/2011 Kumano et al.

FOREIGN PATENT DOCUMENTS

CN 1160915 A 10/1997
CN 102149830 A 8/2011
(Continued)

OTHER PUBLICATIONS

Espacenet Machine Translation of JPH09111346 (Year: 1997).*
(Continued)

*Primary Examiner* — Melvin C. Mayes
*Assistant Examiner* — Christopher Douglas Moody
(74) *Attorney, Agent, or Firm* — Birch, Stewart, Kolasch & Birch, LLP

(57) ABSTRACT

Provided is a method of manufacturing a grain-oriented electrical steel sheet including: a heating process of heating a slab having a predetermined chemical composition at T1° C. of 1150° C. to 1300° C., retaining the slab for 5 minutes to 30 hours, lowering the temperature of the slab to T2° C. of T1−50° C. or lower, heating the slab at T3° C. of 1280° C. to 1450° C., and retaining the slab for 5 minutes to 60 minutes; a hot-rolling process of hot-rolling the slab that is heated to obtain a hot-rolled steel sheet; a cold-rolling process; an intermediate annealing process of performing intermediate annealing with respect to the hot-rolled steel sheet at least one time before the cold-rolling process or
(Continued)

before a final pass of the cold-rolling process after interrupting the cold-rolling; an annealing separating agent applying process; and a secondary film applying process. In the cold-rolling process, a retention treatment is performed during a plurality of passes. In the retention treatment, retention at a temperature T° C. satisfying 170+[Bi]×5000≤T≤300 is performed one time to four times. A heating rate in the decarburization annealing process is 50° C./second or faster.

9 Claims, 2 Drawing Sheets

(51) Int. Cl.

| | |
|---|---|
| ***C22C 38/60*** | (2006.01) |
| ***C21D 8/12*** | (2006.01) |
| ***C22C 38/00*** | (2006.01) |
| ***H01F 1/16*** | (2006.01) |
| ***C22C 38/02*** | (2006.01) |
| ***C22C 38/12*** | (2006.01) |
| ***C22C 38/16*** | (2006.01) |
| ***H01F 1/18*** | (2006.01) |

(52) U.S. Cl.

CPC ..... *C21D 8/1233* (2013.01); *C21D 8/1255* (2013.01); *C21D 8/1261* (2013.01); *C21D 8/1272* (2013.01); *C21D 8/1283* (2013.01); *C21D 9/46* (2013.01); *C22C 38/00* (2013.01); *C22C 38/008* (2013.01); *C22C 38/02* (2013.01); *C22C 38/12* (2013.01); *C22C 38/16* (2013.01); *C22C 38/60* (2013.01); *H01F 1/16* (2013.01); *H01F 1/18* (2013.01); *C21D 2201/05* (2013.01)

(56) References Cited

FOREIGN PATENT DOCUMENTS

| | | | | | |
|---|---|---|---|---|---|
| EP | 1227163 | A2 | | 7/2002 | |
| EP | 1889927 | A1 | | 2/2008 | |
| EP | 2 746 410 | A1 | | 6/2014 | |
| EP | 2963131 | A1 | | 1/2016 | |
| JP | 40-15644 | B | | 7/1965 | |
| JP | 51-13469 | B | | 4/1976 | |
| JP | 61-37917 | A | | 2/1986 | |
| JP | 3-31421 | A | | 2/1991 | |
| JP | H0331421 | | * | 2/1991 | ..... C21C 8/12 |
| JP | 3-87316 | A | | 4/1991 | |
| JP | 6-88171 | A | | 3/1994 | |
| JP | 8-253816 | A | | 10/1996 | |
| JP | 8-333631 | A | | 12/1996 | |
| JP | H09111346 | | * | 4/1997 | ..... C21D 8/12 |
| JP | 10-102149 | A | | 4/1998 | |
| JP | 2001-47202 | A | | 2/2001 | |
| JP | 2001-303131 | A | | 10/2001 | |
| JP | 2003-27196 | A | | 1/2003 | |
| JP | 2003-89821 | A | | 3/2003 | |
| JP | 2003-96520 | A | | 4/2003 | |
| RU | 2 407 809 | C1 | | 12/2010 | |
| RU | 2 471 877 | C1 | | 1/2013 | |
| RU | 2 527 827 | C2 | | 9/2014 | |
| WO | WO 2014/132930 | A1 | | 9/2014 | |

OTHER PUBLICATIONS

Espacenet Machine Translation of JPH0331421 (Year: 1991).*

Extended European Search Report, dated Jul. 23, 2018, for counterpart European Application No. 16773229.6.

Chinese Office Action and Search Report, dated Jun. 28, 2018 for corresponding Chinese Application No. 201680019267.2, with an English translation of the Chinese Search Report.

Russia Office Action dated Sep. 28, 2018 for Russian Application No. 2017133849.

International Search Report for PCT/JP2016/060921 (PCT/ISA/210) dated Jun. 14, 2016.

Written Opinion of the International Searching Authority for PCT/JP2016/060921 (PCT/ISA/237) dated Jun. 14, 2016.

Author Unknown, "Methods of Measurement of the Magnetic Properties of Magnetic Steel Sheet and Strip by Means of a Single Sheet Tester," JIS C 2556, 1996, pp. 2024-2035 (5 pages total).

Japanese Written Opposition to Grant of Patent for counterpart Japanese Application No. 2017-510252, dated Mar. 7, 2019, with English translation.

* cited by examiner

METHOD OF MANUFACTURING GRAIN-ORIENTED ELECTRICAL STEEL SHEET

TECHNICAL FIELD OF THE INVENTION

The present invention relates to a method of manufacturing a grain-oriented electrical steel sheet.

Priority is claimed on Japanese Patent Application No. 2015-075839, filed on Apr. 2, 2015, the content of which is incorporated herein by reference.

RELATED ART

The grain-oriented electrical steel sheet is mainly used as an iron core material of a stationary induction apparatus such as a transformer. According to this, the grain-oriented electrical steel sheet is demanded to have characteristics such as a characteristic in which an energy loss (that is, an iron loss) when being excited with an alternating current is low, a characteristic in which permeability is high and excitation is easy, and a characteristic in which magnetostriction that becomes a cause of noise is small. In the related art, various developments have been made to manufacture the grain-oriented electrical steel sheet that satisfies the above-described characteristics. As a result, for example, as described in Patent Document 1, particularly, an improvement of a {110}<001> orientation integration degree in a steel sheet has a great effect.

To improve the {110}<001> orientation integration degree in the steel sheet, it is important to suppress normal grain growth in primary recrystallization and to subject only {110}<001> orientation particles to abnormal grain growth in the subsequent secondary recrystallization. For this, it is effective to accurately control an in-steel fine precipitate or a grain boundary precipitation element called an inhibitor.

As a method of realizing the above control, there is known a technology in which the inhibitor is solutionized through slab heating, and the inhibitor is uniformly and finely precipitated in a hot-rolling process, a hot-rolled sheet annealing process, and an intermediate annealing process as subsequent processes. As the inhibitor, for example. Patent Document 1 discloses a method of controlling MnS and AlN, Patent Document 2 discloses a method of controlling MnS and MnSe, and Patent Document 3 discloses a method of controlling CuxS, CuxSe, or Cux (Sc, S) and (Al, Si)N.

However, in technologies described in Patent Document 1 to Patent Document 3, there is a problem that it is difficult to stably obtain excellent magnetic characteristics.

Patent Document 4 discloses a measure for adding Bi in a slab in a manufacturing method for stably obtaining an ultra-high-magnetic-flux-density grain-oriented electrical steel sheet. However, when steel contains Bi, there is a problem that deterioration in adhesiveness of a primary film occurs or a primary film is less likely to be formed, by Bi contained in the steel. Therefore, in the technology described in Patent Document 4, even though satisfactory magnetic characteristics are obtained, formation of the primary film may not be sufficient in some cases.

In addition, Patent Document 5 to be described below discloses a technology of improving magnetic characteristics by performing an aging treatment in a process of cold-rolling a steel sheet, which is obtained after annealing of a hot-rolled steel sheet that contains Bi, to a target sheet thickness. However, in Patent Document 5, examination is not made on the film adhesiveness, and it is not clear that the aging treatment has any effect on the primary film.

Patent Document 6 discloses a technology of forming a satisfactory primary film. In the technology, a cold-rolled sheet that contains Bi is heated to 700° C. or higher at a rate of 100° C./second or faster or is heated to 700° C. or higher within 10 seconds. Then, preliminary annealing, in which retention is performed at a temperature of 700° C. or higher for 1 second to 20 seconds, is performed, and decarburization annealing is performed. Then, the amount of $TiO_2$, which is added in an annealing separating agent that is subsequently applied, is increased. However, in the technology disclosed in Patent Document 6, there are lots of problems such as a problem of significantly increasing an addition amount of $TiO_2$ or an application amount of the annealing separating agent in order that a film is not peeled off even when a product is bent along a round bar of 20 mmϕ.

PRIOR ART DOCUMENT

Patent Document

[Patent Document 1] Japanese Examined Patent Application. Second Publication No. S40-15644

[Patent Document 2] Japanese Examined Patent Application, Second Publication No. S51-13469

[Patent Document 3] Japanese Unexamined Patent Application, First Publication No. H10-102149

[Patent Document 4] Japanese Unexamined Patent Application. First Publication No. H6-88171

[Patent Document 5] Japanese Unexamined Patent Application, First Publication No. H8-253816

[Patent Document 6] Japanese Unexamined Patent Application, First Publication No. 2003-096520

DISCLOSURE OF THE INVENTION

Problems to be Solved by the Invention

The present invention has been made in consideration of the above-described problems, and an object thereof is to provide a method of manufacturing a grain-oriented electrical steel sheet which is capable of obtaining the grain-oriented electrical steel sheet having excellent magnetic characteristics at a low cost while improving adhesiveness of a primary film.

Means for Solving the Problem

The present inventors have made a thorough investigation on slab heating conditions, steel sheet retention conditions in a cold-rolling process, an effect due to a heating rate in decarburization annealing, and the like to solve the above-described problems. As a result, it is found that adhesiveness of the primary film is improved by lowering a slab temperature during slab heating, and the slab is reheated and rolled, by retaining a steel sheet in a predetermined temperature range in the cold-rolling process, and by controlling the heating rate appropriately in the decarburization annealing process.

The present invention to be described below in detail is accomplished on the basis of the above-described finding, and the gist of the present invention is as follows.

(1) According to an aspect of the present invention, there is provided a method of manufacturing a grain-oriented electrical steel sheet. The method including: a heating process of heating a slab, which contains, in terms of mass %. C: 0.030% to 0.150%, Si: 2.50% to 4.00%, Mn: 0.02% to 0.30%, one or two of S and Se: 0.005% to 0.040% in a total amount, an acid-soluble Al: 0.015% to 0.040%, N: 0.0030% to 0.015%, Bi: 0.0003% to 0.0100%, Sn: 0% to 0.50%. Cu: 0% to 0.20%, one or two of Sb and Mo: 0% to 0.30% in a total amount, and the remainder including Fe and impurities, to T1° C. of 1150° C. to 1300° C., retaining the slab for 5 minutes to 30 hours, lowering the temperature of the slab to T2° C. of T1-50° C. or lower, heating the slab at T3° C. of 1280° C. to 1450° C., and retaining the slab for 5 minutes to 60 minutes; a hot-rolling process of hot-rolling the slab that is heated to obtain a hot-rolled steel sheet; a cold-rolling process of performing a plurality of passes of cold-rolling with respect to the hot-rolled steel sheet to obtain a cold-rolled steel sheet having a sheet thickness of 0.30 mm or less; an intermediate annealing process of performing intermediate annealing with respect to the hot-rolled steel sheet at least one time before the cold-rolling process or before a final pass of the cold-rolling process by stopping the cold-rolling; a decarburization annealing process of subjecting the cold-rolled steel sheet to decarburization annealing, an annealing separating agent applying process of applying an annealing separating agent to the cold-rolled steel sheet obtained after the decarburization annealing; a final annealing process of performing final annealing with respect to the cold-rolled steel sheet obtained after the annealing separating agent applying process; and a secondary film applying process of applying an insulating film onto the cold-rolled steel sheet obtained after the final annealing. In the intermediate annealing process, the intermediate annealing, in which retention is performed at a temperature of 1000° C. to 1200° C. for 5 seconds to 180 seconds, is performed during the plurality of passes. In the cold-rolling process, a retention treatment, in which the hot-rolled steel sheet is retained one or more times at a temperature of 130° C. to 300° C. for 3 minutes to 120 minutes, is performed. In the retention treatment, retention at a temperature T° C. satisfying Expression (a) is performed one time to four times. A heating rate in the decarburization annealing process is 50° C./second or faster.

$$170+[Bi]\times 5000 \leq T \leq 300 \quad (a)$$

(here, [Bi] in Expression (1) represents the amount of Bi in terms of mass % in the slab)

(2) In the method of manufacturing a grain-oriented electrical steel sheet according to (1), the slab may contain, in terms of mass %, Sn: 0.05% to 0.50%.

(3) In the method of manufacturing a grain-oriented electrical steel sheet according to (1) or (2), the slab may contain, in terms of mass %, Cu: 0.01% to 0.20%.

(4) In the method of manufacturing a grain-oriented electrical steel sheet according to any one of (1) to (3), the slab may contain, in terms of mass %, one or two of Sb and Mo in a total amount of 0.0030% to 0.30%.

(5) In the method of manufacturing a grain-oriented electrical steel sheet according to any one of (1) to (4), in the final annealing process, an X value, which is calculated with Expression (b), may be set to 0.0003 $Nm^3/(h \cdot m^2)$ or greater.

$$X = \text{Atmosphere gas flow rate/total steel sheet surface area} \quad (b)$$

Effects of the Invention

According to the aspect of the present invention, it is possible to obtain a grain-oriented electrical steel sheet having excellent magnetic characteristics while improving adhesiveness of a primary film at a low cost.

EMBODIMENTS OF THE INVENTION

Figure 1:
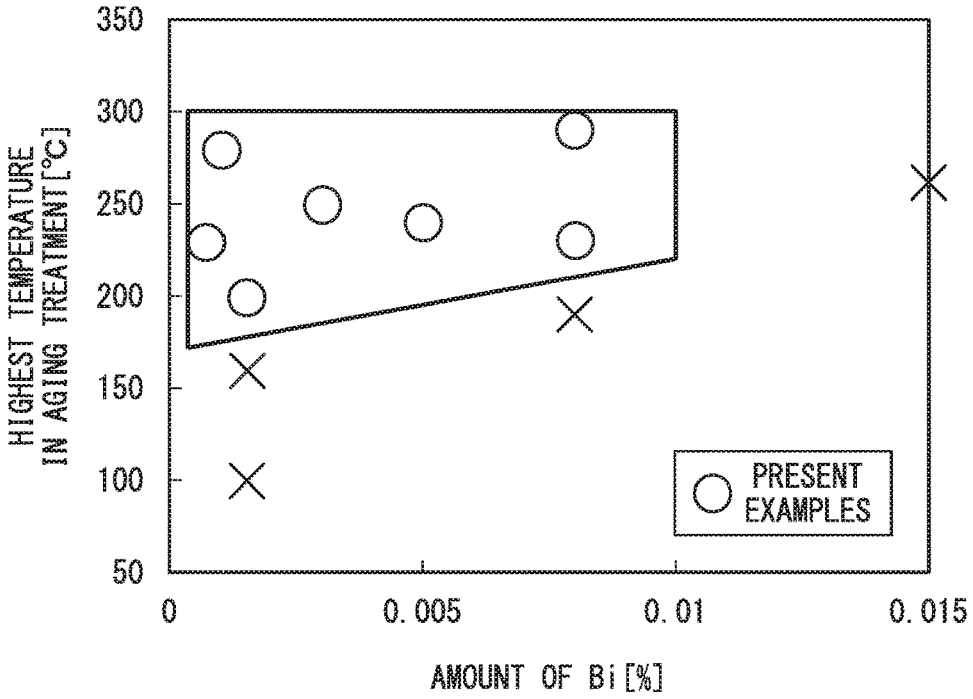
FIG. 1 is a graph illustrating a relationship between the highest temperature in an aging treatment and an amount of Bi in Examples.

Hereinafter, a method of manufacturing a grain-oriented electrical steel sheet according to an embodiment of the present invention (may be referred to as a method of manufacturing a grain-oriented electrical steel sheet according to this embodiment) will be described in detail.

(With Respect to Chemical Composition of Steel)

First, description will be given of a chemical composition (chemical component) of steel that is used in the method of manufacturing the grain-oriented electrical steel sheet according to this embodiment.

In the method of manufacturing the grain-oriented electrical steel sheet according to this embodiment, a slab, which contains, in terms of mass %, C: 0.030% to 0.150%, Si: 2.50% to 4.00%, Mn: 0.02% to 0.30%, one or two of S and Se: 0.005% to 0.040% in a total amount, an acid-soluble Al: 0.015% to 0.04%, N: 0.0030% to 0.0150%, Bi: 0.0003% to 0.0100%, and the remainder including Fe and impurities, is used.

Basically, the slab, which is used in the method of manufacturing the grain-oriented electrical steel sheet according to this embodiment, contains the above-described elements, and the remainder including Fe and impurities. However, the slab may further contain 0.05 to 0.50 mass % of Sn instead of a part of Fe. In addition, the slab may further contain 0.01 to 0.20 mass % of Cu instead of a part of Fe. In addition, the slab may further contain one or two of Sb and Mo in a total amount of 0.0030 to 0.30 mass % instead of a part of Fe. However, Sn. Cu, Sb, and Mo may not be contained. Accordingly, the lower limit of these elements is 0%.

(C: 0.030% to 0.150%)

When the amount of C (carbon) is less than 0.030%, a crystal grain abnormally grows when heating the slab prior to hot-rolling. As a result, secondary recrystallization failure called a linear fine grain occurs in a product. On the other hand, when the amount of C is greater than 0.150%, in decarburization annealing that is performed after cold-rolling process, a long decarburization time is necessary, and is not economical. In addition, decarburization is likely to be incomplete. When the decarburization is incomplete, magnetic failure called magnetic aging occurs in a product. Therefore, the incomplete decarburization is not preferable. Accordingly, the amount of C is set to 0.030%0 to 0.150%, and preferably 0.050% to 0.100%.

(Si: 2.50% to 4.00%)

Si (silicon) is an element that is very effective to reduce an eddy current loss that partially constitutes an iron loss by increasing electrical resistance of steel. However, in a case where the amount of Si is less than 2.50%, it is difficult to suppress the eddy current loss of a product. On the other hand, when the amount of Si is greater than 4.00%, workability of steel significantly deteriorates, and cold-rolling at room temperature becomes difficult. Accordingly, the amount of Si is set to 2.50% to 4.00%, and preferably 2.90% to 3.60%.

(Mn: 0.02% to 0.30%)

Mn (manganese) is an important element that forms MnS and/or MnSe which are compounds called an inhibitor that influences secondary recrystallization. In a case where the amount of Mn is less than 0.02%, an absolute amount of MnS and/or MnSe necessary for causing secondary recrystallization to occur becomes deficient. Accordingly, this range is not preferable. On the other hand, in a case where amount of Mn is greater than 0.30%, since solid-solution of Mn becomes difficult when heating the slab, the amount of MnS and/or MnSe which precipitate decreases, and a precipitation size is likely to be coarse. Therefore, an optimal size distribution as an inhibitor is damaged. Accordingly, the amount of Mn is set to 0.02% to 0.30%, and preferably 0.05% to 0.25%.

(S and/or Se: 0.005% to 0.040% in Total Amount)

S (sulfur) is an important element that reacts with Mn to form MnS that is an inhibitor, and Se (selenium) is an important element that reacts with Mn to form MnSe that is an inhibitor. MnS and MnSe have the same effect as an inhibitor. Accordingly, as long as the total amount of S and Se is in a range of 0.005% to 0.04%, any one of S and Se may be contained, and both of S and Se may be contained. On the other hand, in a case where the total amount of S and/or Se (the total amount of one or two of S and Se) is less than 0.005%, or in a case where the total amount of S and Se is greater than 0.040%, it is difficult to obtain a sufficient inhibitor effect. Accordingly, it is necessary to set the total amount of S and/or Se to 0.005% to 0.040%. The total amount of S and/or Se is preferably 0.010 to 0.035%.

(Acid-Soluble Al: 0.015% to 0.040%)

Acid-soluble aluminum (sol. Al) is a constituent element of AlN that is an inhibitor important to obtain a high-magnetic-flux-density grain-oriented electrical steel sheet. When the amount of acid-soluble Al is less than 0.015%, the amount of an inhibitor becomes deficient, and inhibitor strength becomes deficient. On the other hand, in a case where the amount of acid-soluble Al is greater than 0.040%, AlN that precipitates as an inhibitor becomes coarse. As a result, inhibitor strength decreases. Accordingly, the amount of acid-soluble Al is set to 0.015% to 0.040%, and preferably 0.018% to 0.035%.

(N: 0.0030% to 0.0150%)

N (nitrogen) is an important element that reacts with acid-soluble Al to form AlN. In a case where the amount of N is less than 0.0030%, or in a case where the amount of N is greater than 0.0150%, it is difficult to obtain a sufficient inhibitor effect. Accordingly, the amount of N is limited to 0.0030% to 0.0150%, and preferably 0.0050% to 0.0120%.

(Bi: 0.0003% to 0.0100%)

Bi (bismuth) is an essential element that is contained in the slab in order to obtain an excellent magnetic flux density in manufacturing of the grain-oriented electrical steel sheet according to this embodiment. When the amount of Bi is less than 0.0003%, it is difficult to sufficiently obtain a magnetic flux density improving effect. On the other hand, when the amount of Bi is greater than 0.0100%, the magnetic flux density improving effect is saturated, and there is a high possibility that adhesion failure of a primary film may occur. Accordingly, the amount of Bi is set to 0.0003% to 0.0100%, preferably 0.0005% to 0.0090%, and more preferably 0.0007% to 0.0080%.

(Sn: 0% to 0.50%)

Sn (tin) is not necessary to be contained, but Sn is an element that is effective to stably attain secondary recrystallization of a thin product. In addition. Sn is an element having effect of making a secondary recrystallized grain be small. To obtain these effects, it is necessary to contain 0.05% or greater of Sn. Accordingly, in a case where Sn is contained, it is preferable that the amount of Sn is set to 0.05% or greater. In addition, even when the amount of Sn is greater than 0.50%, the effect is saturated. According to this, even in a case where Sn is contained, it is preferable that the amount of Sn is set to 0.50% or less from the viewpoint of the cost. The amount of Sn is more preferably 0.08% to 0.30%.

(Cu: 0° % to 0.20%)

Cu (copper) is not necessary to be contained, but Cu is an element that is effective to improve a primary film of steel that contains Sn. In a case where the amount of Cu is less than 0.01%, an effect of improving the primary film is small. Accordingly, it is preferable that the amount of Cu is set to 0.01% or greater to obtain the effect. On the other hand, when the amount of Cu is greater than 0.20%, a magnetic flux density decreases. Therefore, this range is not preferable. Accordingly, even when Cu is contained, it is preferable that the amount of Cu is set to 0.01% to 0.20%, and more preferably 0.03% to 0.18%.

[Sb and/or Mo: 0% to 0.30% in Total Amount]

Sb (antimony) and Mo (molybdenum) are not necessary to be contained, but Sb and Mo are effective for stably obtaining secondary recrystallization of a thin product. To obtain this effect in a more reliable manner, it is preferable that the total amount of Sb and/or Mo (the total amount of one or two of Sb and Mo) is set to 0.0030% or greater. Any one of Sb and Mo may be contained, or both of Sb and Mo may be contained. On the other hand, when the total amount of Sb and/or Mo is greater than 0.30%, the above-described effect is saturated. Accordingly, even when being contained, it is preferable that the total amount of Sb and/or Mo is set to 0.30% or less, and more preferably 0.0050% to 0.25%.

(With Respect to Manufacturing Process of Grain-Oriented Electrical Steel Sheet)

Next, manufacturing processes included in the method of manufacturing the grain-oriented electrical steel sheet according to this embodiment will be described in detail. According to the manufacturing method including manufacturing processes to be described below, it is possible to provide a grain-oriented electrical steel sheet that is used in an iron core material of a transformer and the like and has sufficient magnetic characteristics at a low cost.

<Heating Process>

The slab, of which components are adjusted in the above-described ranges, is heated prior to hot-rolling. The slab is obtained by casting molten steel of which components are adjusted in the above-described ranges. A casting method is not particularly limited, and a casting method of molten steel for manufacturing of a typical grain-oriented electrical steel sheet may be applied.

In a method of manufacturing the grain-oriented electrical steel sheet according to this embodiment, when heating the slab having the above described components, the slab is heated to T1° C. of 1150° C. to 1300° C., and is retained (soaked) at T1° C. for 5 minutes to 30 hours. Then, the temperature of the slab is lowered to T2° C. that is equal to or lower than T1−50° C. (that is, T1−T2≥50). Then, the slab is heated again to T3° C. of 1280° C. to 1450° C., and is retained at T3° C. for 5 minutes to 60 minutes. In a case where T1 is lower than 1150° C., T3 is lower than 1280° C.

or the retention time at T1° C. and/or T3° C. is shorter than 5 minutes, it is difficult to obtain desired magnetic characteristics. Particularly, the magnetic characteristics are greatly affected by the retention temperature after the reheating. Accordingly, T3 is preferably 1300° C. or higher. On the other hand, when the heating temperature is too high, a special facility is necessary. Therefore, the manufacturing costs increase. According to this, T3 is preferably 1400° C. or lower.

In addition, when the retention time at T1° C. or T3° C. is long, productivity deteriorates, and thus, the manufacturing cost increases. According to this, the retention time at T1° C. is set to 30 hours or shorter, and preferably 25 hours or shorter. In addition, the retention time at T3° C. is 60 minutes or shorter, and preferably 50 minutes or shorter.

In addition, in a case where T1−T2 is less than 50° C. (T1−T2<50), film adhesiveness deteriorates. This mechanism is not clear, but it is considered that the deterioration is caused by a variation in a surface quality of a steel sheet due to a variation in a behavior of scale formation and descaling during slab heating and hot-rolling. On the other hand, when T1−T2 is too great, special facility is necessary for heating from T2° C. to T3° C. Accordingly, it is preferable that T1−T2 is set to 200° C. or lower. That is, it is preferable to satisfy a relationship of $50 \leq T1-T2 \leq 200$.

In this embodiment, the temperature of the slab is a surface temperature. In addition, temperature lowering from T1° C. to T2° C. may be performed by any method such as water cooling and air cooling, but the air cooling (radiation cooling) is preferable.

<Hot-Rolling Process>

The slab, which is heated in the heating process, is hot-rolled to obtain a hot-rolled steel sheet. Conditions of the hot-rolling are not particularly limited and conditions which are applied to a typical grain-oriented electrical steel sheet may be employed.

<Cold-Rolling Process>

In a cold-rolling process, cold-rolling including a plurality of passes is performed to obtain a cold-rolled steel sheet having a sheet thickness of 0.30 mm or less. In a case where the sheet thickness after the cold-rolling process is greater than 0.30 mm, an iron loss deteriorates. Accordingly, the sheet thickness after the cold-rolling process is set to 0.30 mm or less, and preferably 0.27 mm or less. Furthermore, the lower limit of the sheet thickness after the cold-rolling process is not particularly limited, but it is preferable that the thickness is set to, for example, 0.10 mm or greater, and more preferably 0.15 mm or greater.

In addition, in the cold-rolling process, a retention treatment (aging treatment), in which the steel sheet is retained at a temperature of 130° C. to 300° C. for 3 minutes to 120 minutes, is performed one or more times during the passes. However, in a plurality of the retention treatments, it is necessary to perform a retention treatment (aging treatment) at a temperature TOC satisfying the following Expression (1) for 3 minutes to 120 minutes one time to four times during the retention.

$$170+[Bi]\times 5000 \leq T \leq 300 \quad (1)$$

Here, [Bi] in Expression (1) represents the amount of Bi in the slab (unit:mass %).

In a case where the aging treatment is not performed, the aging treatment temperature is lower than 130° C., or the retention time is shorter than 3 minutes, it is difficult to attain desired magnetic characteristics. On the other hand, in a case where the aging treatment temperature is higher than 300° C. a special facility is necessary, and the manufacturing cost increases. Therefore, this range is not preferable. In addition, when the retention time is longer than 120 minutes, productivity deteriorates, and the manufacturing cost increases. Therefore, this range is not preferable.

In addition, even in a case where the aging treatment is performed one or more times under the above conditions, when the aging treatment satisfying Expression (1) is not performed or the aging treatment satisfying Expression (1) is performed more than four times, film adhesiveness deteriorates. Preferable aging treatment conditions are as in the following Expression (1).

It is preferable that the retention treatment (aging treatment) of the cold-rolling process is performed under the following conditions instead of the above-described conditions. That is, it is preferable that an aging treatment to retain at a temperature of 140° C. to 300° C. for 5 minutes to 120 minutes is performed two or more times, and an aging treatment to retain at a temperature T° C. satisfying the following Expression (1') for 5 minutes to 120 minutes is performed one time to four times. When satisfying the conditions, the film adhesiveness is improved in more stable manner.

$$175+[Bi]\times 5000 \leq T \leq 300 \quad (1')$$

<Intermediate Annealing Process>

Before the cold-rolling process (between the hot-rolling process and the cold-rolling process) or during a plurality of passes of the cold-rolling process (before the final pass of the cold-rolling process after interrupting the cold-rolling process at once), intermediate annealing is performed with respect to the hot-rolled steel sheet at least one time (preferably one time or two times). That is, cold-rolling is performed after annealing (so-called hot-rolled sheet annealing) is performed with respect to the hot-rolled steel sheet before the cold-rolling, the plurality of passes of cold-rolling including intermediate annealing are performed without performing the hot-rolled sheet annealing, or the plurality of passes of cold-rolling including intermediate annealing are performed after the hot-rolled sheet annealing.

In the intermediate annealing process, annealing in which retention is performed at a temperature of 1000° C. to 1200° C. for 5 seconds to 180 seconds is performed. In a case where the annealing temperature is lower than 1000° C., it is difficult to obtain desired magnetic characteristics and film adhesiveness. On the other hand, in a case where the temperature is higher than 1200° C., special facility is necessary, and the manufacturing cost increases. Accordingly the annealing temperature is set to 1000° C. to 1200° C., and preferably 1030° C. to 1170° C.

In addition, in a case where the annealing time is shorter than 5 seconds, it is difficult to obtain desired magnetic characteristics and film adhesiveness. On the other hand, in a case where the annealing time is longer than 180 seconds, special facility is necessary and the manufacturing cost increases. Accordingly, in this embodiment, the annealing time is set to 5 seconds to 180 seconds, and preferably 10 seconds to 120 seconds.

<Decarburization Annealing Process>

Decarburization annealing is performed with respect to the cold-rolled steel sheet after the cold-rolling process. Here, a heating rate during heating in the decarburization annealing is set to 50° C./second or faster. With regard to the heating temperature, the heating time, and the like in the decarburization annealing, conditions which are applied to a typical grain-oriented electrical steel sheet may be employed.

In a case where the heating rate in the decarburization annealing is slower than 50° C./second, it is difficult to obtain desired magnetic characteristics and film adhesiveness. Accordingly, the heating rate is set to 50° C./second or faster, and preferably 80° C./second or faster. The upper limit of the heating rate is not particularly limited, but special facility is necessary to excessively raise the heating rate. Therefore, the heating rate is set to 2000° C./second or slower.

<Annealing Separating Agent Applying Process>

<Final Annealing Process>

An annealing separating agent is applied onto the cold-rolled steel sheet after the decarburization annealing, and final annealing is performed. According to this, a film (primary film) is formed on a surface of the cold-rolled steel sheet.

An atmosphere gas that is used in the final annealing are not particularly limited, and a typically used atmosphere gas such as a gas containing nitrogen and hydrogen may be used. In addition, as methods or conditions in the annealing separating agent application and the final annealing, methods or conditions which are applied to a typical grain-oriented electrical steel sheet may be employed. For example, as the annealing separating agent, an annealing separating agent including MgO as a main component may be used. In this case, a film, which is formed after the final annealing, contains forsterite ($Mg_2SiO_4$).

In the final annealing process, it is preferable that an X value, which is calculated by the following Expression (2), is set to 0.0003 $Nm^3/(h \cdot m^2)$ or greater. When the X values is to 0.0003 $Nm^3/(h \cdot m^2)$ or greater, the film adhesiveness is further improved.

$$X = \text{Atmosphere gas flow rate/total steel sheet surface area} \quad (2)$$

Here, the atmosphere gas flow rate represents the amount of the atmosphere gas that is flowed in when performing box annealing. In addition, the total steel sheet surface area represents an area of a steel sheet that is in contact with the atmosphere, and a total area of a front surface and a rear surface of the steel sheet in a thin steel sheet.

The X value, which is calculated by Expression (2), is more preferably to 0.0005 $Nm^3/(h \cdot m^2)$ or greater. On the other hand, the upper limit of the X value is not particularly limited, but it is preferable that the X value is set to 0.0030 $Nm^3/(h \cdot m^2)$ or less from the viewpoint of the manufacturing cost.

<Secondary Film Applying Process>

An insulating film is applied onto the steel sheet (cold-rolled steel sheet) on which the primary film is formed. According to this, a secondary film is formed on the steel sheet. An application method is not particularly limited, and a method or conditions which are applied to a typical grain-oriented electrical steel sheet may be employed.

<Laser Irradiation Process>

Laser irradiation may be performed with respect to the steel sheet, on which the secondary film is formed. When a groove is formed in the film or a strain is applied to the film through the laser irradiation, it is possible to further improve magnetic characteristics of the grain-oriented electrical steel sheet due to magnetic domain refinement.

In the grain-oriented electrical steel sheet, which is manufactured in this manner, a value of a magnetic flux density B8 is 1.92 T or greater. Accordingly, the grain-oriented electrical steel sheet has excellent magnetic flux density. In addition, film adhesiveness becomes satisfactory in the steel sheet.

When the heating conditions, the intermediate annealing conditions before final cold-rolling, the aging treatment conditions in the cold-rolling, the heating rate in the decarburization annealing, and the like are set in appropriate ranges, the adhesiveness of the film is improved. The reason for this is not clear, but it is considered that the improvement is caused by a variation in surface quality of the steel sheet.

Furthermore, there is no particular limitation to a measurement method of magnetic characteristics such as the magnetic flux density and various kinds of iron losses, and the magnetic characteristics can be measured by a known method such as a method based on an Epstein test defined in JIS C 2550, and a single sheet magnetic characteristic test method (single sheet tester: SST) defined in JIS C 2556.

EXAMPLES

Hereinafter, a method of manufacturing the grain-oriented electrical steel sheet according to the present invention will be described in detail with reference to Examples. The following Examples are merely examples of the method of manufacturing the grain-oriented electrical steel sheet according to the present invention. Accordingly the method of manufacturing the grain-oriented electrical steel sheet of the present invention is not limited to the following Examples.

Example 1

A slab, which contains C: 0.080%, Si: 3.20%, Mn: 0.07%, S: 0.023%, acid-soluble Al: 0.026%, N: 0.0090%, Bi: 0.0015%, and the remainder including Fe and impurities, was heated to a temperature T1° C. of 1130° C. to 1280° C. in terms of a surface temperature, and then retention was performed for 5 hours. Then, the surface temperature of the slab was lowered to a temperature T2° C. of 1050° C. to 1220° C. Then, the surface temperature of the slab was raised to 1350° C., and retention was performed for 20 minutes. Then, hot-rolling was performed with respect to the slab to obtain a hot-rolled coil having a thickness of 2.3 mm.

In addition, intermediate annealing (hot-rolled sheet annealing), in which retention is performed at a temperature of 1120° C. for 20 seconds, was performed with respect to the hot-rolled coil and then cold-rolling was performed, and cold-rolling was performed to obtain a cold-rolled steel sheet having a thickness of 0.22 mm. Then, decarburization annealing was performed with respect to the cold-rolled steel sheet under conditions in which a heating temperature was set to 850° C. and retention time was set to 120 seconds. A heating rate at this time was set to 300° C./second.

Next, an annealing separating agent containing MgO as a main component was applied onto the cold-rolled steel sheet, and final annealing was performed in an atmosphere gas containing nitrogen and hydrogen in a ratio of 3:1 in a state in which a gas flow rate, that is, atmosphere gas flow rate/total steel sheet surface area was set to 0.0008 $Nm^3/(h \cdot m^2)$. Then, application of a secondary film (insulating film) was performed.

With respect to the steel sheet that was obtained, a magnetic flux density B8 when being magnetized with 800 A/m was measured by single sheet magnetic measurement (SST) defined in JIS C 2556, and adhesiveness of the film was evaluated. The film adhesiveness was evaluated as the following grades A to D. That is, a case where peeling-off did not occur at a 10ϕ bending test was evaluated as A, a case where peeling-off did not occur at a 20ϕ bending test was evaluated as B, a case where peeling-off did not occur at a 30ϕ bending test was evaluated as C, and a case where peeling-off occurred at a 30ϕ bending test was evaluated as D. A and B were determined as passing. In addition, with regard to the magnetic flux density B8, 1.92 T or greater was determined as passing.

Results are illustrated in Table 1. Steel sheet Nos. 3, 5, and 6 correspond to a manufacturing method that satisfies the ranges of the present invention, and a magnetic flux density and a film grade satisfy target values. On the other hand, in steel sheet No. 1, the slab surface temperature (T1) during heating is lower than a predetermined temperature, and desired magnetic characteristics are not obtained. In steel sheet No. 2, the slab surface temperature (T1) during heating is lower than a predetermined temperature, and a temperature difference between T1 and T2 is small. Therefore, the desired magnetic characteristics and film grade are not obtained. In steel sheet No. 4, the temperature difference between T1 and T2 is smaller than a predetermined range. Therefore, the desired film grade is not obtained.

TABLE 1

| STEEL SHEET NO. | SLAB SURFACE TEMPERATURE T1 [° C.] | T2 [° C.] | T1 − T2 [° C.] | B8 [T] | FILM GRADE | REMARKS |
|---|---|---|---|---|---|---|
| 1 | 1130 | 1050 | 80 | 1.90 | B | COMPARATIVE EXAMPLE |
| 2 | 1130 | 1100 | 30 | 1.90 | C | COMPARATIVE EXAMPLE |
| 3 | 1200 | 1140 | 60 | 1.92 | B | PRESENT EXAMPLE |
| 4 | 1200 | 1180 | 20 | 1.93 | C | COMPARATIVE EXAMPLE |
| 5 | 1280 | 1180 | 100 | 1.93 | A | PRESENT EXAMPLE |
| 6 | 1280 | 1220 | 60 | 1.93 | B | PRESENT EXAMPLE |

Example 2

Slabs, which contain C: 0.080%, Si: 3.20%, Mn: 0.08%, S: 0.025%, acid-soluble Al: 0.024%, N: 0.0080%, Bi: 0.0007% to 0.015%, and the remainder including Fe and impurities, were heated to a temperature 1200° C. (T1° C.) in terms of a surface temperature, and then retention was performed for 5 hours. Then, the surface temperature of the slab was lowered to a temperature 1100° C. (T2° C.). Then, the surface temperature of the slab was raised to 1350° C. (T3° C.), and retention was performed for 30 minutes. Then, the slab was hot-rolled to obtain a hot-rolled coil having a thickness of 2.3 mm.

In addition, hot-rolled sheet annealing, in which retention is performed at a temperature of 1100° C. for 30 seconds, was performed with respect to the hot-rolled coil and cold-rolling was performed, and cold-rolling including an aging treatment was performed to obtain a cold-rolled steel sheet having a thickness of 0.22 mm. At this time, a temperature, time, and the number of times of the aging treatment were variously changed.

Then, decarburization annealing was performed with respect to the cold-rolled steel sheet under conditions in which a heating temperature was set to 850° C. and retention time was set to 150 seconds. A heating rate in the decarburization annealing was set to 350° C./second.

Next, an annealing separating agent containing MgO as a main component was applied onto the cold-rolled steel sheet, and final annealing was performed in an atmosphere gas containing nitrogen and hydrogen in a ratio of 3:1 in a state in which a gas flow rate, that is, atmosphere gas flow rate/total steel sheet surface area was set to 0.0006 $Nm^3/(h \cdot m^2)$. Then, application of a secondary film was performed.

The amount of Bi and aging treatment conditions in the cold-rolling process are illustrated in Table 2.

Using the obtained steel sheet, the magnetic flux density B8 when being magnetized with 800 A/m was measured by the single sheet magnetic measurement (SST), and adhesiveness of the film was evaluated. An evaluation method and the passing standard were the same as in Example 1.

Figure 2:
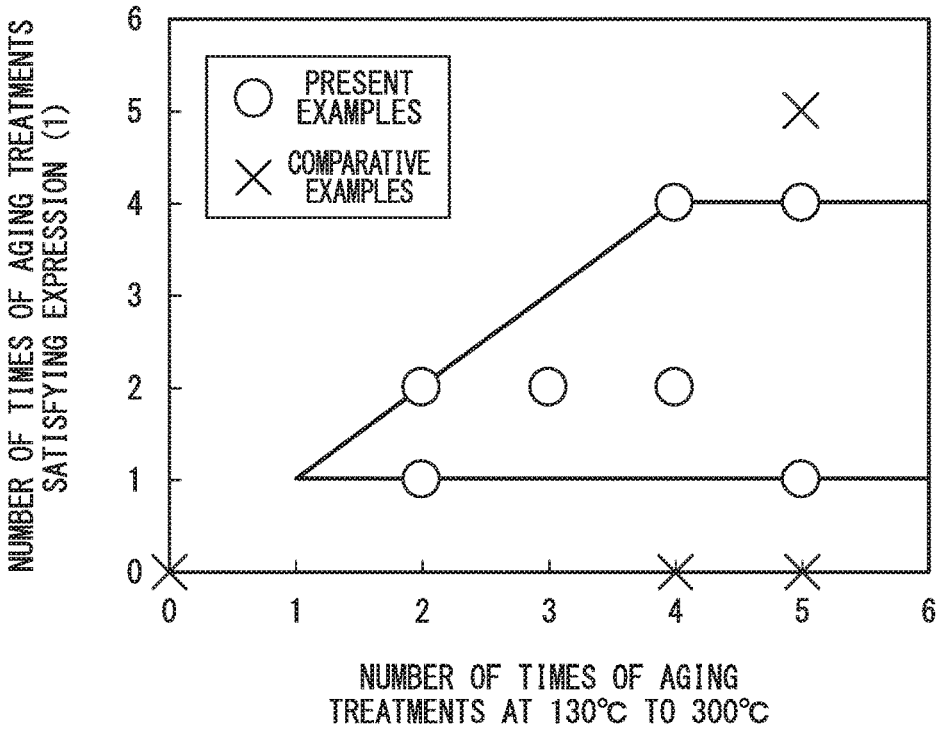
FIG. 2 is a graph illustrating a relationship between the number of times of aging treatments satisfying Expression (1) and the number of times of aging treatments at 130° C. to 300° C. in Examples.

Grades, which represent the magnetic flux density B8 and the film adhesiveness, are illustrated in Table 2. In addition, a relationship between the highest temperature in the aging treatment and the amount of Bi is illustrated in FIG. 1, and a relationship between the number of times of the aging treatment satisfying Expression (1), and the number of times of the aging treatment at 130° C. to 300° C. is illustrated in FIG. 2

TABLE 2

| STEEL SHEET NO. | AMOUNT OF Bi [%] | AGING TREATMENT CONDITIONS | HIGHEST TEMPERATURE IN AGING TREATMENT [° C.] |
|---|---|---|---|
| 7 | 0.0015 | 100° C. AND 20 MINUTES × FIVE TIMES | 100 |
| 8 | 0.0015 | 160° C. AND 20 MINUTES × FIVE TIMES | 160 |
| 9 | 0.0080 | 190° C. AND 20 MINUTES × FOUR TIMES | 190 |
| 10 | 0.0040 | 250° C. AND 15 MINUTES × FIVE TIMES | 250 |
| 11 | 0.0150 | 160° C. AND 30 MINUTES × THREE TIMES + 260° C. AND 10 MINUTES × TWO TIMES | 260 |
| 12 | 0.0015 | 160° C. AND 5 MINUTES × ONE TIME + 200° C. AND 15 MINUTES × ONE TIME | 200 |
| 13 | 0.0010 | 280° C. AND 20 MINUTES × TWO TIMES | 280 |
| 14 | 0.0007 | 140° C. AND 15 MINUTES × ONE TIME + 230° C. AND 45 MINUTES × TWO TIMES | 230 |
| 15 | 0.0080 | 160° C. AND 60 MINUTES × TWO TIMES + 230° C. AND 30 MINUTES × TWO TIMES | 230 |
| 16 | 0.0050 | 160° C. AND 45 MINUTES × ONE TIME + 240° C. AND 15 MINUTES × FOUR TIMES | 240 |
| 17 | 0.0080 | 160° C. AND 15 MINUTES × FOUR TIMES + 290° C. AND 15 MINUTES × FOUR TIMES | 290 |
| 18 | 0.0030 | 160° C. AND 90 MINUTES × ONE TIME + 250° C. AND 5 MINUTES × THREE TIMES | 250 |

TABLE 2-continued

| STEEL SHEET NO. | NUMBER OF TIMES OF AGING TREATMENTS AT 130° C. TO 300° C. | NUMBER OF TIMES OF AGING TREATMENTS SATISFYING EXPRESSION (1) | B8 [T] | FILM GRADE | REMARKS |
|---|---|---|---|---|---|
| 7 | 0 | 0 | 1.90 | B | COMPARATIVE EXAMPLE |
| 8 | 5 | 0 | 1.92 | C | COMPARATIVE EXAMPLE |
| 9 | 4 | 0 | 1.93 | D | COMPARATIVE EXAMPLE |
| 10 | 5 | 5 | 1.92 | C | COMPARATIVE EXAMPLE |
| 11 | 5 | 2 | 1.93 | C | COMPARATIVE EXAMPLE |
| 12 | 2 | 1 | 1.92 | A | PRESENT EXAMPLE |
| 13 | 2 | 2 | 1.93 | B | PRESENT EXAMPLE |
| 14 | 3 | 2 | 1.92 | A | PRESENT EXAMPLE |
| 15 | 4 | 2 | 1.93 | B | PRESENT EXAMPLE |
| 16 | 5 | 4 | 1.93 | A | PRESENT EXAMPLE |
| 17 | 5 | 1 | 1.92 | B | PRESENT EXAMPLE |
| 18 | 4 | 4 | 1.92 | A | PRESENT EXAMPLE |

As illustrated in steel sheet No. 7, in a case where the aging treatment was not performed, it was difficult to obtain the desired magnetic characteristics. As illustrated in steel sheet Nos. 8 to 10, in a case where the aging treatment at a temperature satisfying Expression (1) was not performed or the number of times was great, the film grade became C or D and was poor. In addition, as illustrated in steel sheet No. 11, in a case where the amount of Bi was greater than 0.0100%, the film grade became C and was poor.

On the other hand, as illustrated in steel sheet Nos. 12 to 18, in a case where the aging treatment conditions were appropriate, the magnetic characteristics and the film grade were excellent.

Example 3

A slab, which contains C: 0.078%, Si: 3.25%, Mn: 0.07%, S: 0.024%, acid-soluble Al: 0.026%, N: 0.0082%, and Bi: 0.0024%, was heated until the slab surface temperature reached 1180° C. (T1° C.), and then retention was performed for 1 hour. Then, the surface temperature of the slab was lowered until reaching 1090° C. (T2° C.). Then, the slab was heated until the surface temperature of the slab reached 1360° C. (T3° C.), and retention was performed for 45 minutes. Then, the slab was hot-rolled to obtain a hot-rolled coil having a thickness of 2.3 mm.

In addition, hot-rolled sheet annealing, in which retention is performed at a temperature of 950° C. to 1150° C. for 50 seconds, was performed with respect to the hot-rolled coil and then cold-rolling was performed to obtain a cold-rolled steel sheet having a sheet thickness of 0.22 mm. Furthermore, in the cold-rolling, an aging treatment, in which retention is performed at a temperature of 160° C. for 30 minutes, was performed two times, and an aging treatment, in which retention is performed at a temperature of 240° C. for 30 minutes was performed.

Then, decarburization annealing was performed with respect to the cold-rolled steel sheet under conditions in which a heating temperature was set to 820° C. and retention time was set to 150 seconds. At this time, a heating rate in the decarburization annealing was set to 20° C./second to 400° C./second. Next, an annealing separating agent containing MgO as a main component was applied onto the cold-rolled steel sheet, and final annealing was performed in an atmosphere gas containing nitrogen and hydrogen in a ratio of 2:1 in a state in which a gas flow rate, that is, atmosphere gas flow rate/total steel sheet surface area was set to 0.0010 $Nm^3/(h \cdot m^2)$. Then, application of a secondary film (insulating film) was performed.

The intermediate annealing (hot-rolled sheet annealing) temperature and the heating rate in the decarburization annealing process are illustrated in Table 3.

Figure 3:
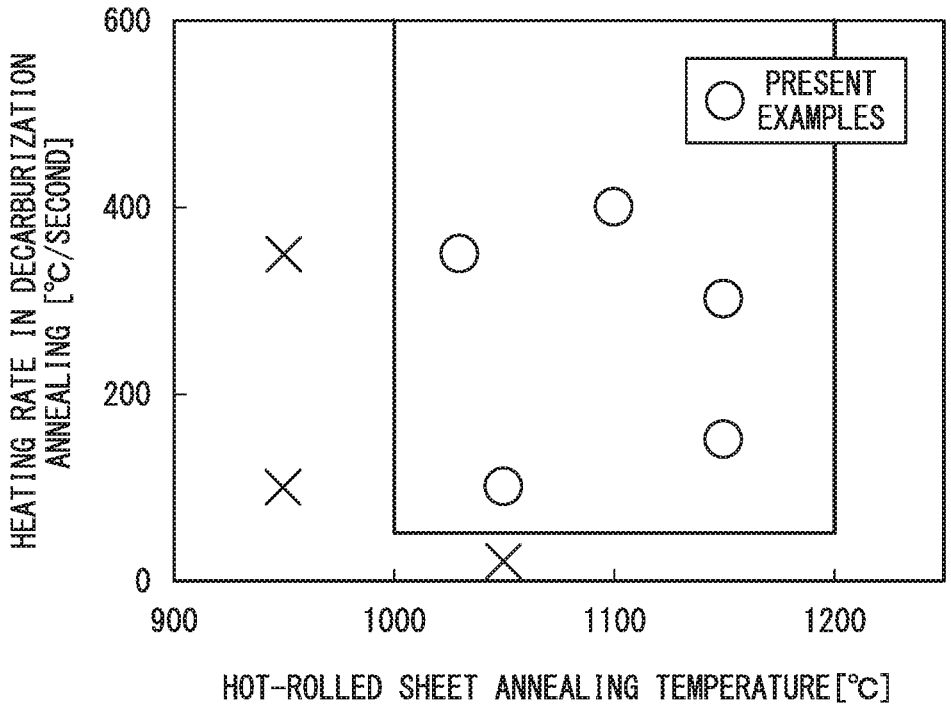
FIG. 3 is a graph illustrating preferable ranges of a heating rate in decarburization annealing and a hot-rolled sheet annealing temperature in Examples.

In addition, the magnetic flux density B8 of the obtained steel sheet and the film grade of the primary film were evaluated in the same manner as in Example 1 and Example 2. Results are illustrated in Table 3. FIG. 3 illustrates preferable ranges of the heating rate in the decarburization annealing and the hot-rolled sheet annealing temperature.

TABLE 3

| STEEL SHEET NO. | HOT-ROLLED SHEET ANNEALING TEMPERATURE [° C.] | HEATING RATE IN DECARBURIZATION ANNEALING [° C./SECOND] | B8 [T] | FILM GRADE | REMARKS |
|---|---|---|---|---|---|
| 19 | 950 | 100 | 1.90 | C | COMPARATIVE EXAMPLE |
| 20 | 950 | 350 | 1.92 | C | COMPARATIVE EXAMPLE |

TABLE 3-continued

| STEEL SHEET NO. | HOT-ROLLED SHEET ANNEALING TEMPERATURE [° C.] | HEATING RATE IN DECARBURIZATION ANNEALING [° C./SECOND] | B8 [T] | FILM GRADE | REMARKS |
|---|---|---|---|---|---|
| 21 | 1050 | 20 | 1.89 | C | COMPARATIVE EXAMPLE |
| 22 | 1050 | 100 | 1.92 | B | PRESENT EXAMPLE |
| 23 | 1030 | 350 | 1.92 | A | PRESENT EXAMPLE |
| 24 | 1150 | 150 | 1.92 | B | PRESENT EXAMPLE |
| 25 | 1150 | 300 | 1.93 | A | PRESENT EXAMPLE |
| 26 | 1100 | 400 | 1.93 | A | PRESENT EXAMPLE |

As illustrated in steel sheet Nos. 19 and 20, when the hot-rolled sheet annealing temperature was low, the film grade became C and was poor. In addition, as illustrated in steel sheet No. 21, when the heating rate in the decarburization annealing was slow, both of the magnetic characteristics and the film grade were poor.

On the other hand, as illustrated in steel sheet Nos. 22 to 26, in a case where the hot-rolled sheet annealing conditions and the heating rate in the decarburization annealing were in appropriate ranges, the magnetic characteristics and the film grade were excellent.

Example 4

Slabs having a composition (the remainder including Fe and impurities) illustrated in Table 4 were heated until the surface temperature reached 1210° C. (T1° C.), and were retained for two hours. After the surface temperature was lowered to 1100° C. (T2° C.), the surface temperature was raised to a temperature (T3° C.) of 1320° C. to 1450° C., and retention was performed for 10 minutes. Then, hot-rolling was performed to obtain hot-rolled steel sheets having a sheet thickness of 2.0 mm to 2.4 mm. Intermediate annealing (hot-rolled sheet annealing), in which retention is performed at a temperature of 1000° C. to 1150° C. for 10 seconds, was performed with respect to the hot-rolled steel sheets. A sheet thickness of some of the annealed steel sheets was set to 0.22 mm through cold-rolling, and a sheet thickness of the remaining annealed steel sheets were set to an intermediate sheet thickness of 1.9 mm to 2.1 mm. Then, intermediate annealing, in which retention is performed at a temperature of 1080° C. to 1100° C. for 20 seconds, was performed, and cold-rolling was performed to obtain a sheet thickness of 0.22 ml. In cold-rolling for obtaining the final sheet thickness, an aging treatment was performed in which retention is performed at a temperature of 160° C. for 20 minutes, and an aging treatment was performed in which retention is performed at a temperature of 250° C. for 5 minutes. The decarburization annealing, in which retention is performed at a temperature of 800° C. for 180 seconds, was performed with respect to the cold-rolled steel sheets.

Next, an annealing separating agent containing MgO as a main component was applied onto the cold-rolled steel sheets, and final annealing was performed in an atmosphere gas containing nitrogen and hydrogen in a ratio of 1:2 in a state in which a gas flow rate, that is, atmosphere gas flow rate/total steel sheet surface area was set to 0.0025 $Nm^3/(h \cdot m^2)$.

Then, secondary film application and a magnetic domain refinement treatment was performed with laser irradiation were performed.

TABLE 4

| | COMPONENTS [mass %] | | | | | | | | | | | |
|---|---|---|---|---|---|---|---|---|---|---|---|---|
| STEEL | C | Si | Mn | S | Se | sol-Al | N | Bi | Sn | Cu | Sb | Mo |
| A | 0.077 | 3.20 | 0.07 | — | 0.025 | 0.027 | 0.0085 | 0.0075 | — | — | 0.03 | — |
| B | 0.079 | 3.15 | 0.09 | 0.027 | — | 0.027 | 0.0087 | 0.0070 | 0.10 | — | — | — |
| C | 0.083 | 3.29 | 0.07 | 0.024 | — | 0.024 | 0.0078 | 0.0025 | 0.06 | 0.10 | — | — |
| D | 0.068 | 3.31 | 0.09 | — | 0.015 | 0.022 | 0.0075 | 0.0085 | — | — | 0.01 | 0.02 |
| E | 0.072 | 3.35 | 0.09 | 0.010 | 0.015 | 0.023 | 0.0082 | 0.0050 | — | — | — | 0.02 |
| F | 0.081 | 3.30 | 0.08 | 0.025 | — | 0.022 | 0.0081 | 0.0060 | — | 0.15 | — | — |

Treatment conditions in respective processes are illustrated in Table 5. In addition, results, which are obtained by evaluating the magnetic flux density B8 and the film grade in the same manner as in Examples 1 to 3, are illustrated in Table 5.

TABLE 5

| STEEL SHEET NO. | STEEL | SLAB HEATING TEMPERATURE [° C.] | THICKNESS OF HOT-ROLLED SHEET [mm] | HOT-ROLLED SHEET ANNEALING TEMPERATURE [° C.] | INTERMEDIATE THICKNESS [mm] | INTERMEDIATE ANNELAING TEMPERATURE [° C.] | B8 [T] | FILM GRADE | REMARKS |
|---|---|---|---|---|---|---|---|---|---|
| 27 | A | 1350 | 2.5 | 1050 | 2.1 | 1100 | 1.92 | B | PRESENT EXAMPLE |
| 28 | A | 1450 | 2.3 | 1150 | — | — | 1.92 | B | PRESENT EXAMPLE |
| 29 | B | 1400 | 2.1 | 1000 | 1.9 | 1080 | 1.93 | B | PRESENT EXAMPLE |
| 30 | B | 1350 | 2.3 | 1130 | — | — | 1.92 | A | PRESENT EXAMPLE |
| 31 | C | 1350 | 2.0 | 1090 | — | — | 1.92 | B | PRESENT EXAMPLE |
| 32 | D | 1430 | 2.4 | 1100 | — | — | 1.93 | B | PRESENT EXAMPLE |
| 33 | E | 1350 | 2.4 | 1100 | — | — | 1.92 | A | PRESENT EXAMPLE |
| 34 | F | 1320 | 2.4 | 1100 | — | — | 1.92 | B | PRESENT EXAMPLE |

As is clear from Table 5, in steel sheet Nos. 27 to 34, the composition and the conditions of the manufacturing processes were in predetermined ranges, and desired magnetic characteristics and film grade were obtained.

Hereinbefore, a preferred embodiment of the present invention and examples have been described in detail with reference to the accompanying drawings, but the present invention is not limited to the examples. It should be understood by those skilled in the art that various modification examples and variation examples can be made without departing from the range of the technical sprit described in the appended claims, and pertain to the technical scope of the present invention.

INDUSTRIAL APPLICABILITY

According to the present invention, it is possible to obtain a grain-oriented electrical steel sheet having excellent magnetic characteristics while improving adhesiveness of a primary film at a low cost.

The invention claimed is:

1. A method of manufacturing a grain-oriented electrical steel sheet, comprising:

a heating process of heating a slab, which contains, in terms of mass %, C: 0.030% to 0.150%, Si: 2.50% to 4.00%, Mn: 0.02% to 0.30%, one or two of S and Se: 0.005% to 0.040% in a total amount, an acid-soluble Al: 0.015% to 0.040%, N: 0.0030% to 0.0150%, Bi: 0.0003% to 0.0100%, Sn: 0% to 0.50%, Cu: 0% to 0.20%, one or two of Sb and Mo: 0% to 0.30% in a total amount, and the remainder including Fe and impurities, to a surface temperature T1° C. of 1150° C. to 1300° C., retaining the slab for 5 minutes to 30 hours, lowering the surface temperature of the slab to T2° C. of T1-200° C. to T1-50° C., heating the surface temperature of the slab to T3° C. of 1280° C. to 1450° C., and retaining the slab for 5 minutes to 60 minutes;

a hot-rolling process of hot-rolling the slab that is heated to obtain a hot-rolled steel sheet;

a cold-rolling process of performing a cold-rolling including a plurality of passes with respect to the hot-rolled steel sheet to obtain a cold-rolled steel sheet having a sheet thickness of 0.30 mm or less;

an intermediate annealing process of performing an intermediate annealing with respect to the hot-rolled steel sheet at least one time before the cold-rolling process or before a final pass of the cold-rolling process after interrupting the cold-rolling;

a decarburization annealing process of decarburization annealing with respect to the cold-rolled steel sheet;

an annealing separating agent applying process of applying an annealing separating agent to the cold-rolled steel sheet after the decarburization annealing;

a final annealing process of performing a final annealing with respect to the cold-rolled steel sheet after the annealing separating agent applying process; and a secondary film applying process of applying an insulating film onto the cold-rolled steel sheet after the final annealing, wherein in the intermediate annealing process, the intermediate annealing, in which a retention is performed at a temperature of 1000° C. to 1200° C. for 5 seconds to 180 seconds, is performed, in the cold-rolling process, a retention treatment, in which the hot-rolled steel sheet is retained one or more times at a temperature of 130° C. to 300° C. for 3 minutes to 120 minutes, is performed during the plurality of passes, in the retention treatment, a retention at a temperature 1° C. satisfying the following Expression (1) is performed one time to four times, and a heating rate in the decarburization annealing process is 50° C./second or faster, $$170+[Bi]\times 5000 \leq T \leq 300 \quad (1)$$

(here, [Bi] in Expression (1) represents the amount of Bi in terms of mass % in the slab).

2. The method of manufacturing a grain-oriented electrical steel sheet according to claim 1, wherein the slab contains, in terms of mass %, Sn: 0.05% to 0.50%.

3. The method of manufacturing a grain-oriented electrical steel sheet according to claim 1 or 2, wherein the slab contains, in terms of mass %, Cu: 0.01% to 0.20%.

4. The method of manufacturing a grain-oriented electrical steel sheet according to claim 1 or 2, wherein the slab contains, in terms of mass %, one or two of Sb and Mo in a total amount of 0.0030% to 0.30%.

5. The method of manufacturing a grain-oriented electrical steel sheet according to claim 1 or 2, wherein in the final annealing process, an X value, which is calculated with the following Expression (2), is set to 0.0003 $Nm^3/(hm^2)$ or greater, $$X = \text{Atmosphere gas flow rate/total steel sheet surface area} \quad (2).$$

6. The method of manufacturing a grain-oriented electrical steel sheet according to claim 3, wherein the slab contains, in terms of mass %, one or two of Sb and Mo in a total amount of 0.0030% to 0.30%.

7. The method of manufacturing a grain-oriented electrical steel sheet according to claim 3, wherein in the final annealing process, an X value, which is calculated with the following Expression (2), is set to 0.0003 $Nm^3/(h \cdot m^2)$ or greater, $$X = \text{Atmosphere gas flow rate/total steel sheet surface area} \quad (2).$$

8. The method of manufacturing a grain-oriented electrical steel sheet according to claim 4, wherein in the final annealing process, an X value, which is calculated with the following Expression (2), is set to 0.0003 $Nm^3/(h \cdot m^2)$ or greater, $$X = \text{Atmosphere gas flow rate/total steel sheet surface area} \quad (2).$$

9. The method of manufacturing a grain-oriented electrical steel sheet according to claim 6, wherein in the final annealing process, an X value, which is calculated with the following Expression (2), is set to 0.0003 $Nm^3/(h \cdot m^2)$ or greater, $$X = \text{Atmosphere gas flow rate/total steel sheet surface area} \quad (2).$$

* * * * *